US011064825B2

(12) United States Patent
Serafini

(10) Patent No.: US 11,064,825 B2
(45) Date of Patent: Jul. 20, 2021

(54) SHEET SETS WITH ATTACHMENT DEVICES

(71) Applicant: Michael Serafini, Moosic, PA (US)

(72) Inventor: Michael Serafini, Moosic, PA (US)

( * ) Notice: Subject to any disclaimer, the term of this patent is extended or adjusted under 35 U.S.C. 154(b) by 0 days.

(21) Appl. No.: 16/801,649

(22) Filed: Feb. 26, 2020

(65) Prior Publication Data

US 2020/0187683 A1 Jun. 18, 2020

Related U.S. Application Data

(63) Continuation-in-part of application No. 15/443,338, filed on Feb. 27, 2017, now abandoned, which is a continuation-in-part of application No. 29/509,502, filed on Nov. 18, 2014, now abandoned.

(51) Int. Cl.

| | |
|---|---|
| ***A47G 9/02*** | (2006.01) |
| ***A47C 21/02*** | (2006.01) |
| ***A47G 9/04*** | (2006.01) |

(52) U.S. Cl.

CPC ..... *A47G 9/0246* (2013.01); *A47C 21/022* (2013.01); *A47G 9/0207* (2013.01); *A47G 9/04* (2013.01)

(58) Field of Classification Search

CPC ..... A47G 9/04; A47G 9/0207; A47G 9/0246; A47G 9/0261; A47G 9/0238; A47G 2009/0269; A47C 21/022

See application file for complete search history.

(56) References Cited

U.S. PATENT DOCUMENTS 2,525,713 A * 10/1950 North ..... A47G 9/02 5/494
2,821,723 A * 2/1958 Gluck ..... A47G 9/0238 5/501
3,013,283 A * 12/1961 Steffinich ..... A47G 9/0246 5/497
3,179,958 A * 4/1965 Carris ..... A47G 9/0238 5/496
3,181,179 A * 5/1965 Roddey, Jr. ..... A47C 31/105 5/497
3,530,487 A * 9/1970 Beer ..... A47G 9/02 5/496
3,962,739 A * 6/1976 Crockett ..... A47G 9/02 5/497
4,021,869 A * 5/1977 Root ..... A47G 9/0246 5/498
4,411,034 A * 10/1983 Williams ..... A47D 15/02 340/568.2
4,488,323 A * 12/1984 Colburn ..... A47C 21/022 5/496
4,615,061 A * 10/1986 Scott ..... A47G 9/02 5/497

(Continued)

*Primary Examiner* — Nicholas F Polito
*Assistant Examiner* — Morgan J McClure
(74) *Attorney, Agent, or Firm* — Remenick PLLC

(57) ABSTRACT

Sheet sets are disclosed herein that comprise a fitted sheet adapted to be placed over a mattress, a top sheet adapted to be placed atop the fitted sheet and having a first width, a sheet extension extending from a first edge of the top sheet and having a second width, wherein the second width is shorter than the first width, and at least one fastening device adapted to couple the top sheet to the fitted sheet.

14 Claims, 15 Drawing Sheets

(56) References Cited

U.S. PATENT DOCUMENTS 4,672,702 A * 6/1987 Isham ..... A47G 9/02 5/497
4,841,588 A * 6/1989 Harbin ..... A47G 9/0207 5/494
5,020,177 A * 6/1991 Etherington ..... A47G 9/02 5/496
5,099,531 A * 3/1992 Schmier ..... A47G 9/02 5/692
5,118,553 A * 6/1992 Boisson ..... A47G 9/0238 24/381
5,165,128 A * 11/1992 Honig ..... A47G 9/0246 5/482
5,515,799 A * 5/1996 Heptner ..... A47G 9/0246 112/475.08
5,557,814 A * 9/1996 Cybulski ..... A47G 9/02 5/485
5,794,285 A * 8/1998 Burch ..... A47G 9/02 5/494
5,884,349 A * 3/1999 Gretsinger ..... A47C 21/022 5/494
5,901,389 A * 5/1999 Manner ..... A47G 9/02 5/482
6,061,851 A * 5/2000 Crowell ..... A47G 9/02 5/482
6,108,836 A * 8/2000 Keene, III ..... A47G 9/02 5/482
6,286,162 B1 * 9/2001 Huart ..... A47G 9/02 5/482
6,353,947 B1 * 3/2002 McCain ..... A47C 31/105 5/497
6,499,157 B1 * 12/2002 McCain ..... A47C 31/105 5/497
6,725,477 B2 * 4/2004 Ciaglia ..... A47G 9/02 5/497
6,854,139 B2 * 2/2005 Lamy ..... A47G 9/02 5/482
7,086,102 B1 * 8/2006 Frazier ..... A47G 9/02 5/494
7,140,053 B1 * 11/2006 Mangano ..... A47G 9/02 5/493
7,143,457 B2 * 12/2006 Macdonald ..... A47G 9/0246 5/499
7,398,570 B2 * 7/2008 Seago ..... A47G 9/0246 5/497
7,487,561 B2 * 2/2009 Ho ..... A47G 9/02 5/482
7,669,257 B2 * 3/2010 Swihart ..... A47G 9/02 5/496
8,156,585 B2 * 4/2012 Medici ..... A47G 9/0207 5/495
8,370,974 B2 * 2/2013 Caines ..... A47G 9/0246 5/485
8,601,621 B2 * 12/2013 Aprile ..... A47G 9/0246 5/495
8,635,724 B2 * 1/2014 Moorhouse ..... A47G 9/02 5/482
8,950,024 B1 * 2/2015 Hudson ..... A47G 9/02 5/485
9,549,625 B1 * 1/2017 Wilkinson ..... A47G 9/0223
9,924,813 B1 * 3/2018 Basten ..... A47G 9/02
10,016,078 B1 * 7/2018 McDermott ..... A47G 9/02
10,368,654 B2 * 8/2019 Sopher ..... A47C 21/028
2007/0271699 A1 * 11/2007 Sacchetti ..... A47G 9/02 5/495
2008/0010746 A1 * 1/2008 Ho ..... A47G 9/0238 5/482
2008/0040855 A1 * 2/2008 Ho ..... A47G 9/0238 5/482
2010/0058537 A1 * 3/2010 Schuck ..... A47C 21/028 5/493
2010/0064435 A1 * 3/2010 Stuart ..... A47G 9/02 5/490
2011/0023234 A1 * 2/2011 Bolish ..... A47G 9/02 5/496
2012/0186015 A1 * 7/2012 Shattuck ..... A47G 9/0261 5/485
2012/0233776 A1 * 9/2012 Agarwall ..... A47G 9/0238 5/496
2014/0013510 A1 * 1/2014 Mcaleney ..... A47G 9/02 5/496
2014/0059765 A1 * 3/2014 Harris ..... A61G 1/04 5/485
2015/0007389 A1 * 1/2015 Blethen ..... A47G 9/0246 5/494
2015/0143632 A1 * 5/2015 Obrentz ..... A47G 9/062 5/417
2016/0029821 A1 * 2/2016 Atkinson ..... A47G 9/1081 5/636
2016/0058214 A1 * 3/2016 Preston ..... A47G 9/0238 5/496

* cited by examiner

SHEET SETS WITH ATTACHMENT DEVICES

REFERENCE TO RELATED APPLICATIONS

This application is a Continuation-In-Part of U.S. Non-Provisional application Ser. No. 15/443,338, filed Feb. 27, 2017, entitled "Sheet Sets with Attachment Devices," which is a Continuation-In-Part of U.S. Design Application Ser. No. 29/509,502, filed Nov. 18, 2014, entitled "Combination Flat and Fitted Bed Sheet," both of which are hereby specifically and entirely incorporated by reference.

BACKGROUND

1. Field of the Invention

The invention is directed to sheet sets. In particular, the invention is directed to sheet sets with attachment devices to maintain the arrangement of the sheets during use.

2. Background of the Invention

Bed sheet sets typically come with a fitted sheet and a flat sheet. Sheet sets may additionally include one or more pillow cases. The fitted sheet fits over the mattress or a mattress pad. Typically, a fitted sheet is comprised of a flat portion that sits on top of the mattress and side panels that envelope the sides of the mattress. The side panels may have elastic portions along the edges to help secure the fitted sheet to the mattress. The fitted sheet may also be secured using a drawstring instead of elastic or another fastening device. The fitted sheet is preferably secured from slipping off the mattress while the bed is in use. Flat sheets are typically square or rectangular pieces of material that sit atop the fitted sheet and may be tucked around the fitted sheet and under the mattress. Additionally, blankets or comforters may be used on top of the sheets to provide extra warmth.

Beds and their corresponding bed sheets come in a variety of sizes to accommodate one or more people. Some common sizes include Twin (39" wide×75" long), Twin Extra Long ("Twin XL") (39" wide×80" long), Full (54" wide×75" long), Queen (60" wide×80" long), and King (76" wide×80" long). Additionally, smaller size beds, such as cribs, are made for infants and children. However, beds can come in other shapes and sizes. Often with custom sized and shaped beds custom sized and shaped sheets need to be made.

During use of a bed, the sheets and blankets may become disarrayed and the bed needs to be remade. Remaking of the bed may entail removal of the top sheet and any blankets to make sure that are properly replaced on the bed for the next use. Proper placement may include positioning the head edge of the sheet at the head of the bed (the portion of the bed where a user typically places their head), positioning the foot edge of the sheet at the foot of the bed (the portion of the bed where a user typically places their feet), and ensuring that the correct side of the sheet is facing up. Such rearranging of the sheets and blankets is time consuming. Furthermore, when washing the sheets, the sheets typically separate and it is difficult and time consuming to properly rearrange the sheets for placement on the bed. Therefore, there is a need for a device that can easily maintain the arrangement of the sheets during use of the bed and during washing.

SUMMARY OF THE INVENTION

The present invention overcomes the problems and disadvantages associated with current strategies and designs and provides new devices and systems to properly maintain the arrangement of sheet sets.

One embodiment of the invention is directed to a sheet set. The sheet set comprises a fitted sheet adapted to be placed over a mattress, a top sheet adapted to be placed atop the fitted sheet and having a first width, a sheet extension extending from a first edge of the top sheet and having a second width, wherein the second width is shorter than the first width, and at least one fastening device adapted to couple the top sheet to the fitted sheet.

In a preferred embodiment, the at least one fastening device is a button coupled to a foot of the fitted sheet and is adapted to engage a button hole in the sheet extension. Preferably, the at least one fastening device is a button coupled to the sheet extension and is adapted to engage a button hole in a foot of the fitted sheet. Preferably, the at least one fastening is adapted to engage both a button hole in a foot of the fitted sheet and a button hole in the sheet extension.

The sheet set preferably further comprises a cutout on each side of sheet extension and adapted to allow the top sheet to lay flat on top of the fitted sheet. In a preferred embodiment, the top sheet lays flat without bunching or overlapping in the corners. The at least one fastening device preferably only couples a foot of the fitted sheet to the sheet extension. The sheet set preferably comprises a securement device coupled to one or more edges of the fitted sheet adapted to secure the fitted sheet to the mattress. Preferably, the top sheet, without the sheet extension, has a length equal to a length of the mattress. Preferably, the at least one fastening device is positioned along a foot side of the mattress. In a preferred embodiment, the sheet extension has a length equal to the depth of the mattress.

Preferably, the sheet set further comprises one of a comforter and a duvet cover. Preferably, the at least one fastening device is adapted to engage a hole in the comforter or duvet cover. In a preferred embodiment, the duvet cover comprises an extension with at least one hole adapted to receive the at least one fastening device.

Other embodiments and advantages of the invention are set forth in part in the description, which follows, and in part, may be obvious from this description, or may be learned from the practice of the invention.

DESCRIPTION OF THE DRAWING

The invention is described in greater detail by way of example only and with reference to the attached drawing, in which.

DESCRIPTION OF THE INVENTION

Figure 1:
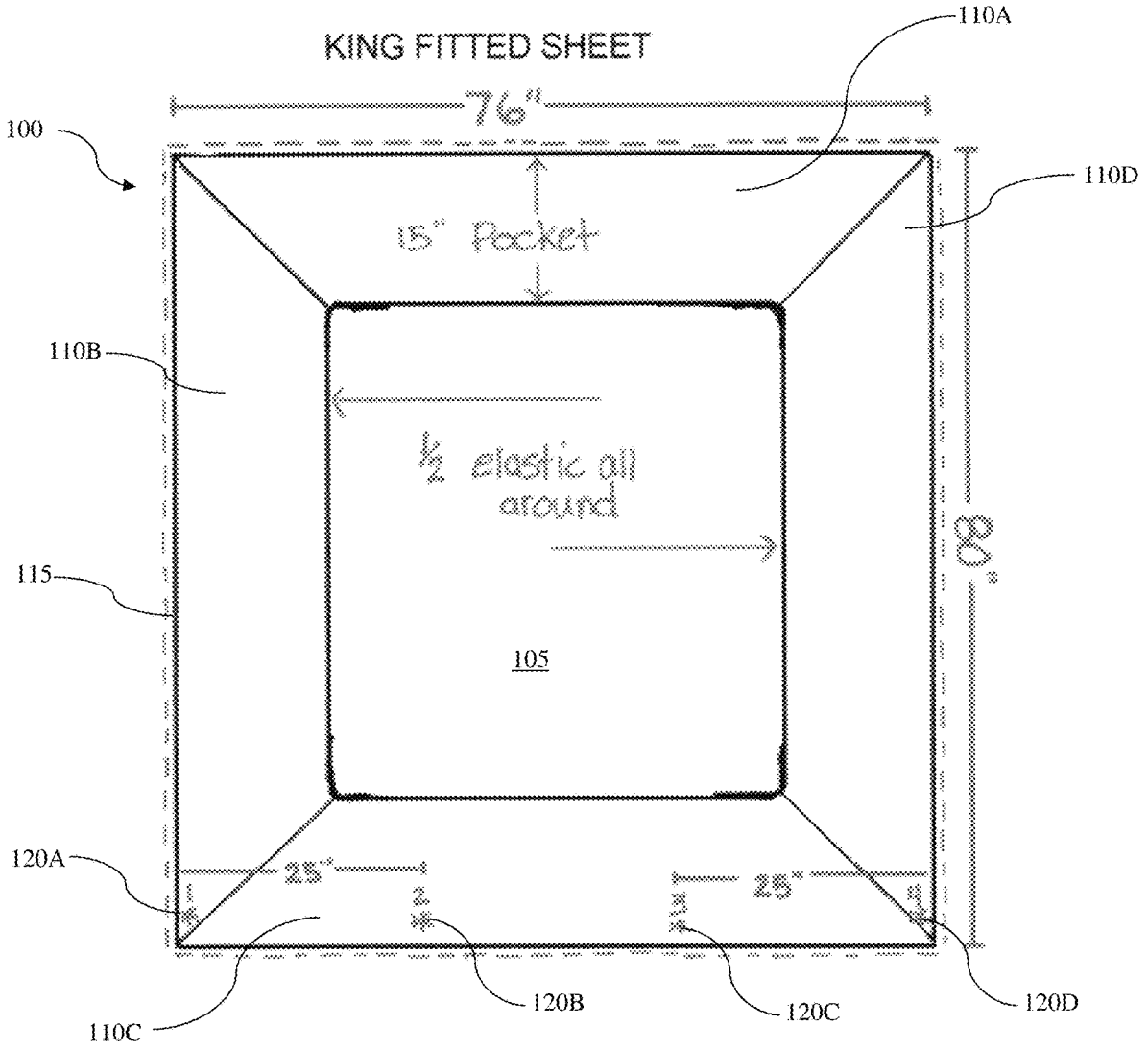
FIG. 1 depicts an embodiment of a King size fitted sheet.
Figure 2:
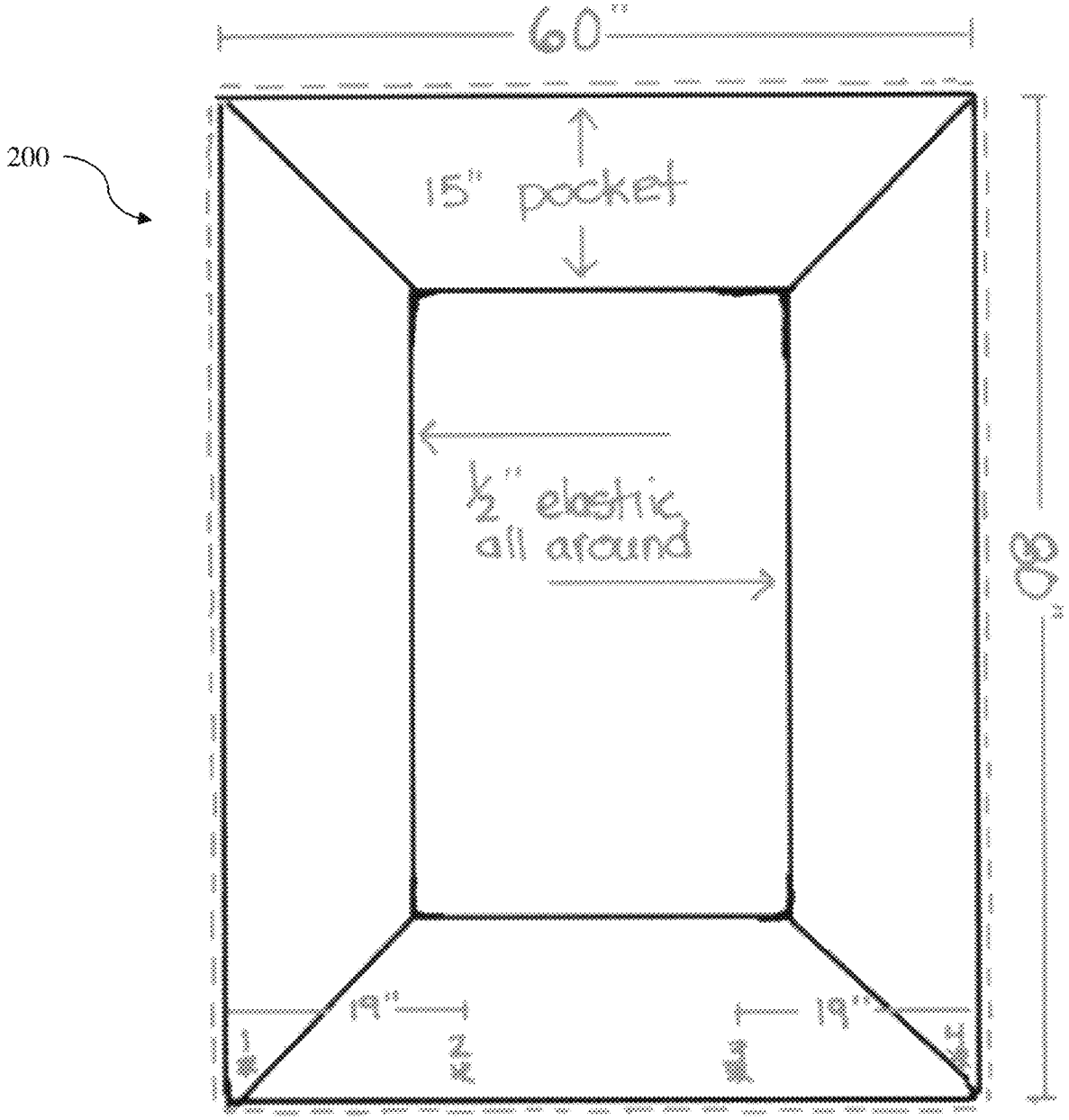
FIG. 2 depicts an embodiment of a Queen size fitted sheet.
Figure 3:
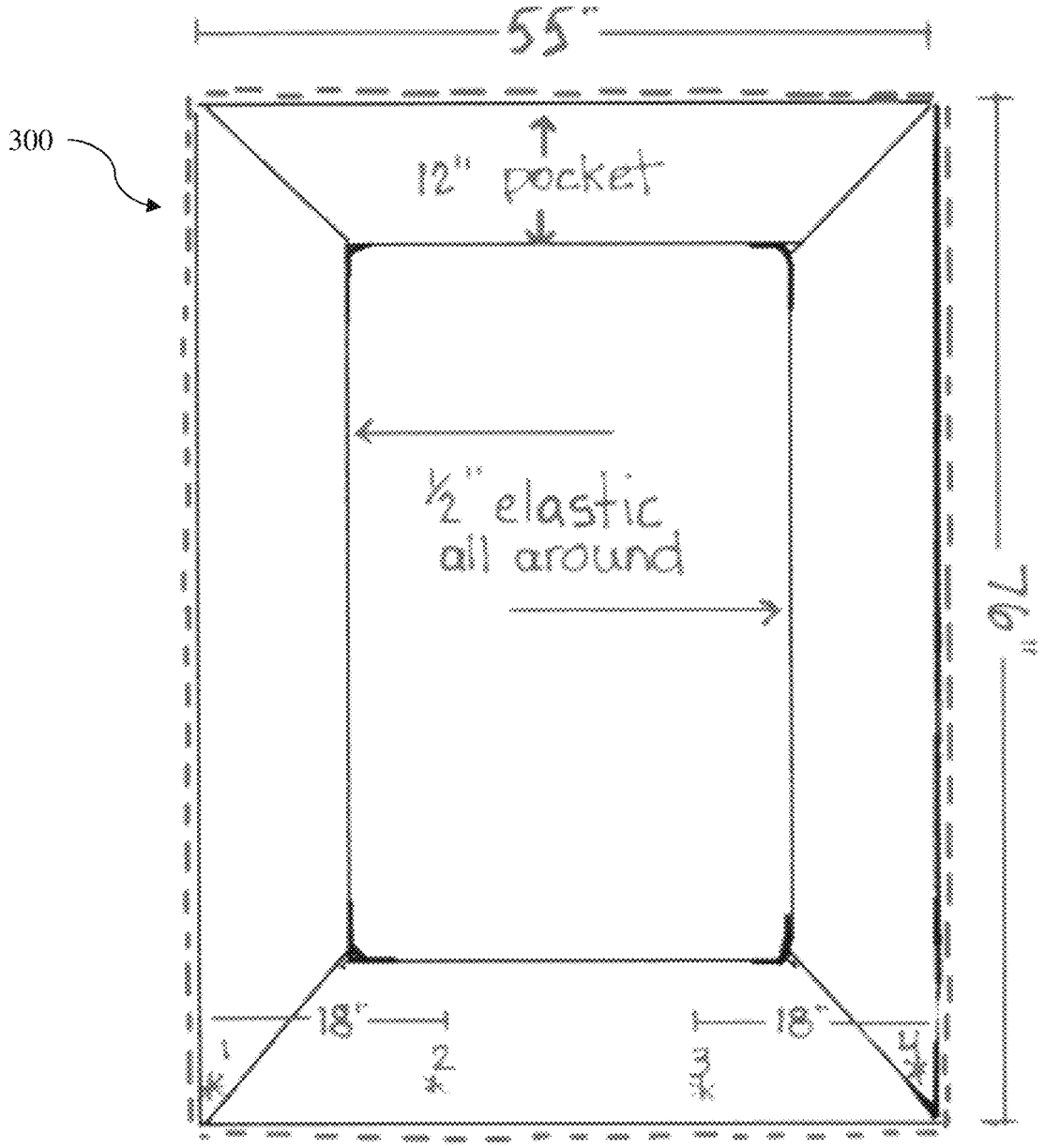
FIG. 3 depicts an embodiment of a Full size fitted sheet.
Figure 4:
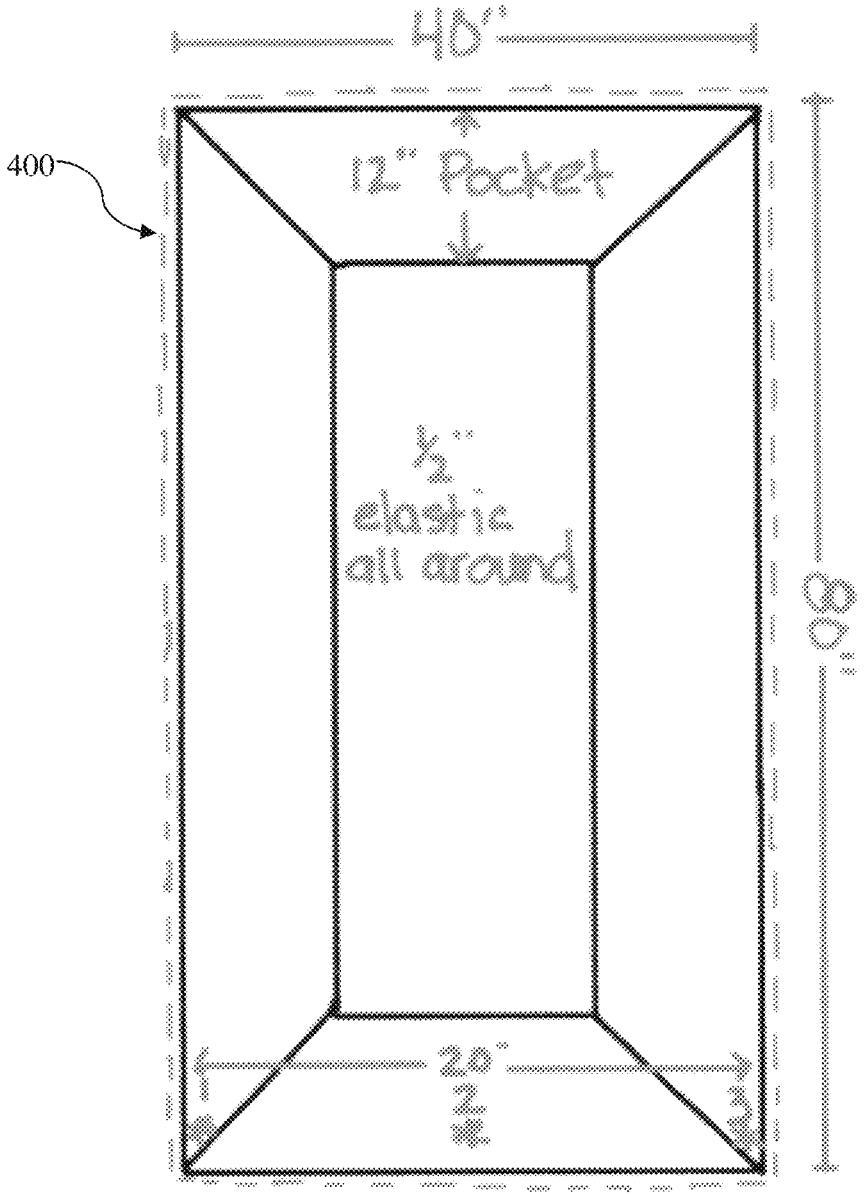
FIG. 4 depicts an embodiment of a Twin XL size fitted sheet.
Figure 5:
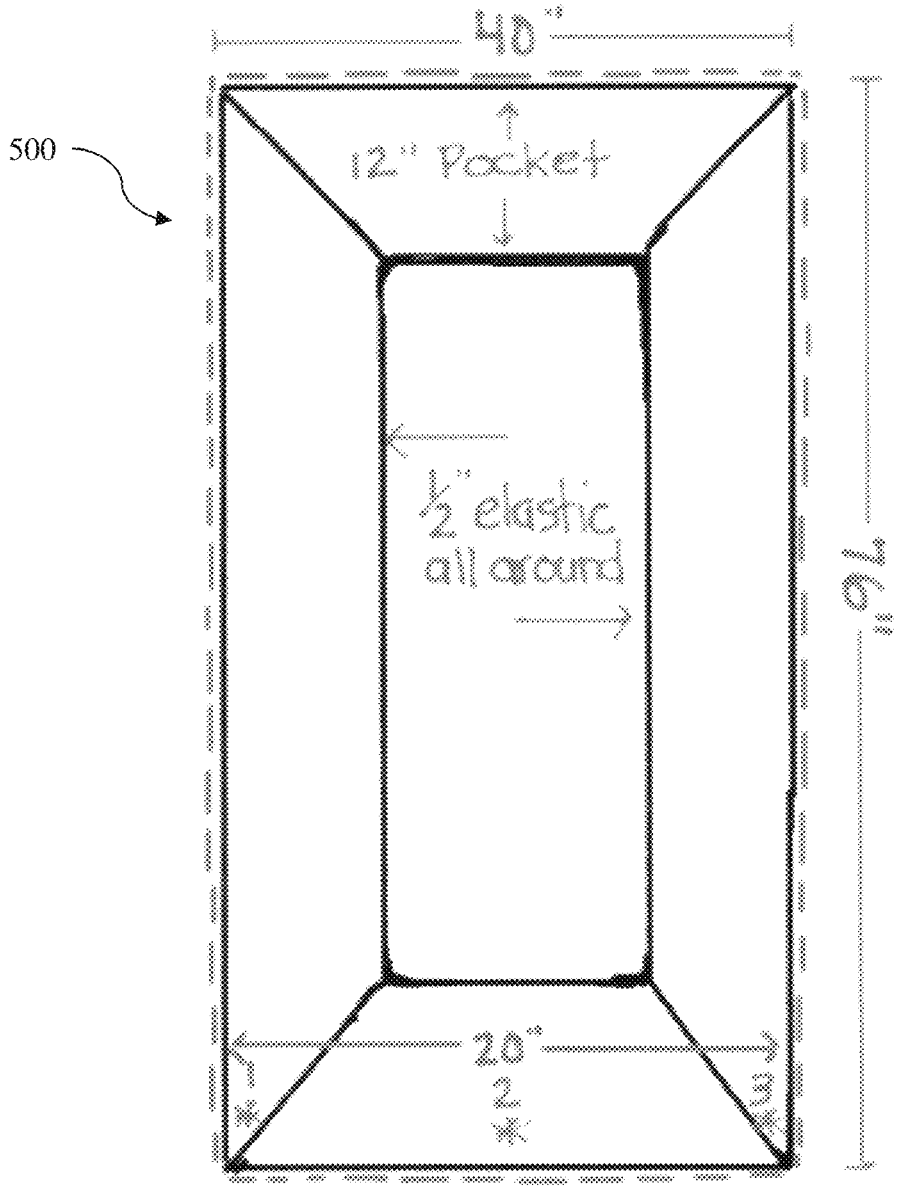
FIG. 5 depicts an embodiment of a Twin size fitted sheet.

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention FIG. 1 depicts an embodiment of a King size fitted sheet 100. FIG. 2 depicts an embodiment of a Queen size fitted sheet 200. FIG. 3 depicts an embodiment of a Full size fitted sheet 300. FIG. 4 depicts an embodiment of a Twin XL size fitted sheet 400. FIG. 5 depicts an embodiment of a Twin size fitted sheet 500. The embodiments of the different sized fitted sheets shown in FIGS. 1-5 have similar design with different sizes and fixture placement to accommodate the corresponding sized bed. Therefore, the description of FIG. 1 also applies to FIGS. 2-5. The sheets disclosed herein may be comprised of any fabric, for example, cotton, wool, silk, burlap, felt, bamboo, hemp, nylon, linen, polyester, polypropylene, other cloths, other naturally occurring or manmade materials, and combinations thereof.

In the preferred embodiment, fitted sheet 100 is comprised of a flat top portion 105 and side portions 110A-D. Side portions 110A-D preferably extend perpendicularly from flat top port 105 and are adapted to envelope the sides of a mattress. For example, as shown, side portions 110A and 110C have a length that corresponds with the length of the head and the foot of the appropriate mattress (King size in the example shown in FIG. 1). Similarly, side portions 110B and 110D have a length that corresponds with the length of the sides of the appropriate mattress (King size in the example shown in FIG. 1). Side portions 110A-D preferably all have a depth that can accommodate multiple depth mattresses. For example, side portions 110A-D may be 10" in depth, 12" in depth, 15" in depth, 17" in depth or another depth. Preferably, the edge of side portions 110A-D that is opposite the edge that is attached to top portion 105 has a securement device 115 that is adapted to removably secure fitted sheet 100 to a mattress. The securement device 115 may be elastic, adhesive, ties, snaps, buttons, toggles, another device, or combinations thereof. In the preferred embodiment, fitted sheet 100 is adapted to be placed on top of a mattress and side portions 110A-D are adapted to envelop the sides of the mattress with the ends of side portions 110A-D being secured under the mattress.

Preferably, side portion 110C, which is preferably the foot of fitted sheet 100 has one or more sheet coupling devices 120A-D. While four sheet coupling devices 120A-D are shown there can be more or fewer sheet coupling devices. For example, fitted sheet 100 may have 2, 3, 5, 6 or another number of sheet coupling devices. In the preferred embodiment, all of the sheet coupling devices are positioned along the foot portion of fitted sheet 100. By positioning all of the sheet coupling devices along the foot of fitted sheet 100, the sheets preferably will not restrict movement of the bed user into and out of the bed especially during an emergency. However, it is possible to position sheet coupling devices along the sides of fitted sheet 100 and/or along the head of fitted sheet 100. Preferably, each sheet coupling device is positioned within the side portions 110A-D, however sheet coupling devices may be positioned on the top potion 105 of fitted sheet 100.

Each sheet coupling device is preferably at least one of a button, a button hole, a male or female portion of a snap closure, a grommet, a tie or tassel, adhesive, or another fastening device. Preferably, coupling device is a temporary device that is able to couple and uncouple the sheet set as desired, yet is capable of maintaining the sheets in contact during use. However, in other embodiments, the sheets are permanently coupled together. In embodiments where the coupling device is a button hole, a grommet, or another type of hole, the hole may be reinforced with extra fabric or another material. Additionally, the hole edges may be secured to prevent fraying, for example, with thread. In embodiments where the coupling device is a button hole, a grommet, or another type of hole, a toggle, button, or other device may be inserted into the hole to secure the top sheet to the fitted sheet. The toggle, button, or other device may be coupled to the top sheet or may be adapted to be inserted into holes in both the fitted sheet and the top sheet. The securement device may resemble a cufflink. For example, the device may have one fixed portion and one movable portion, two fixed portions coupled by a chain, rope, or other flexible device, or may be unmovable. The securement device may be made of fabric, metal, plastic, wood, or other manmade or naturally occurring materials and combinations thereof.

Figure 6:
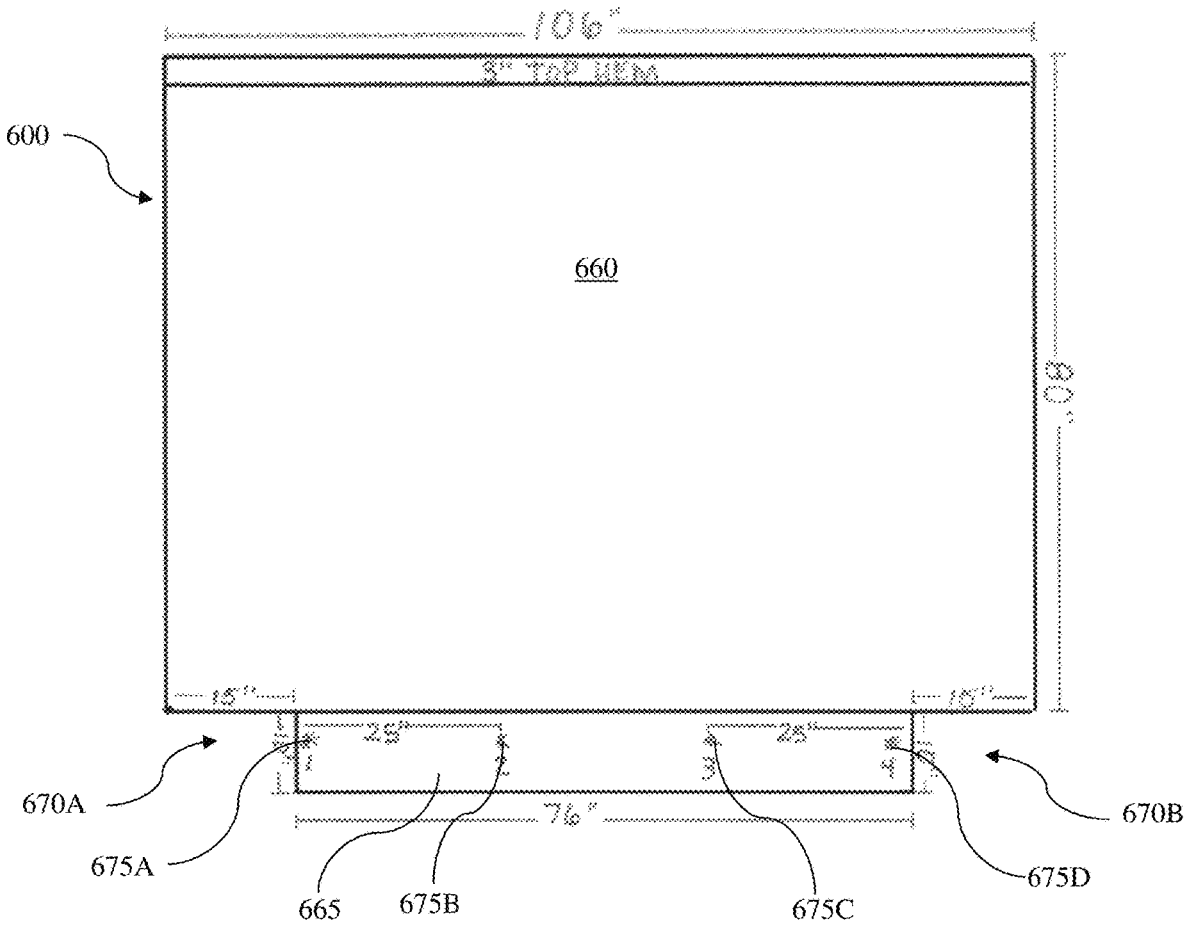
FIG. 6 depicts an embodiment of a King size top sheet.
Figure 7:
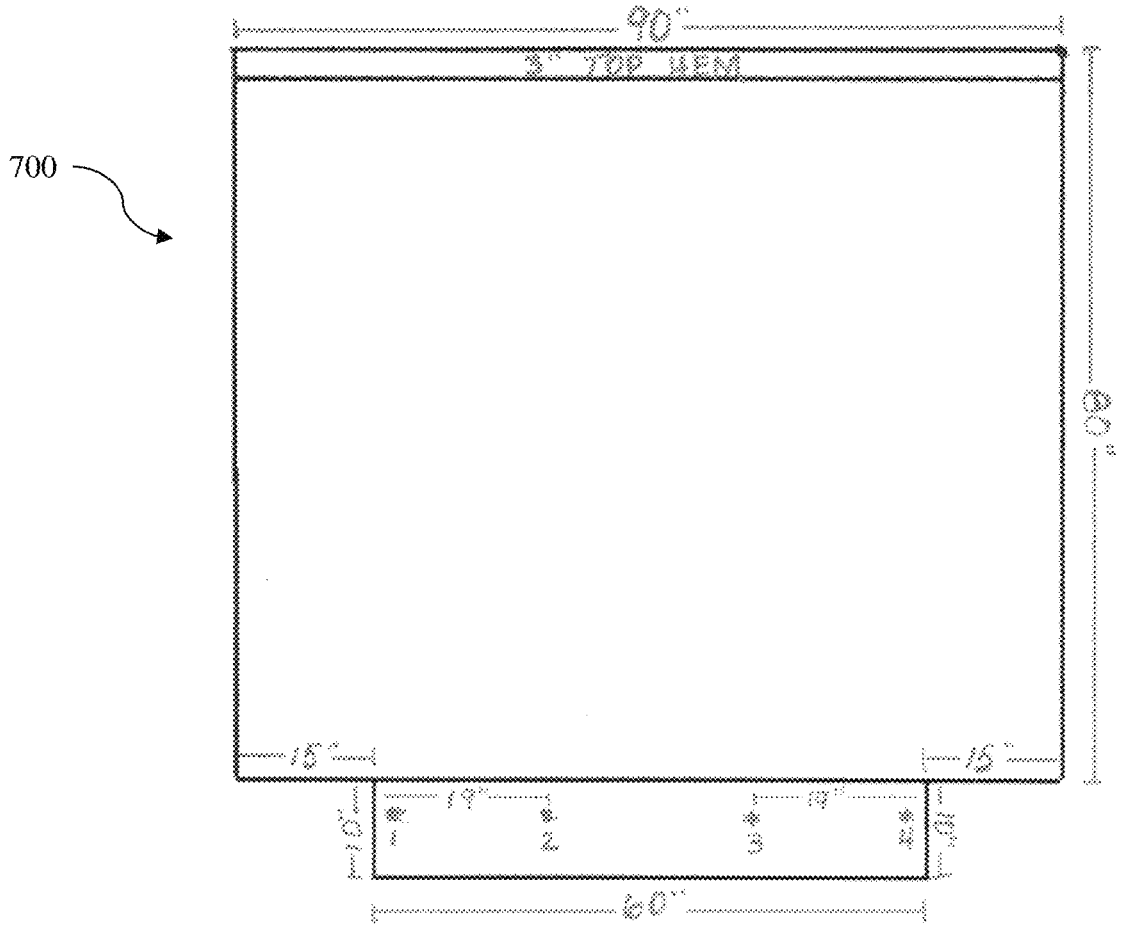
FIG. 7 depicts an embodiment of a Queen size top sheet.
Figure 8:
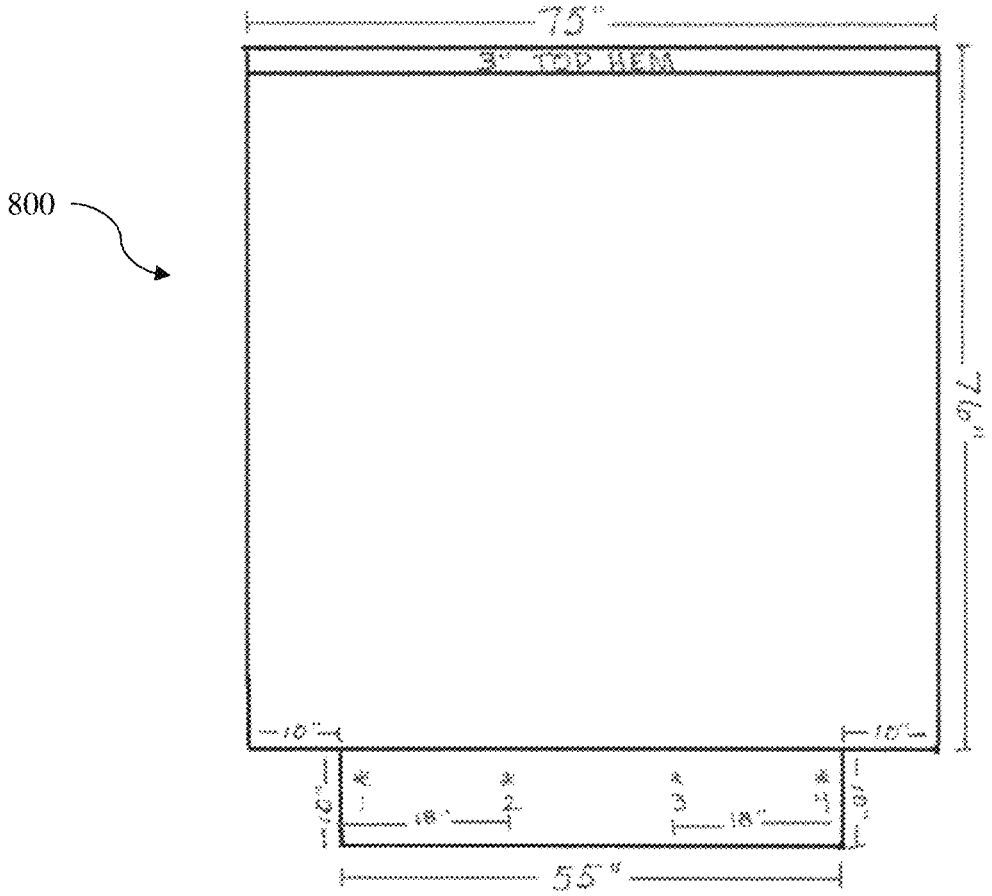
FIG. 8 depicts an embodiment of a Full size top sheet.
Figure 9:
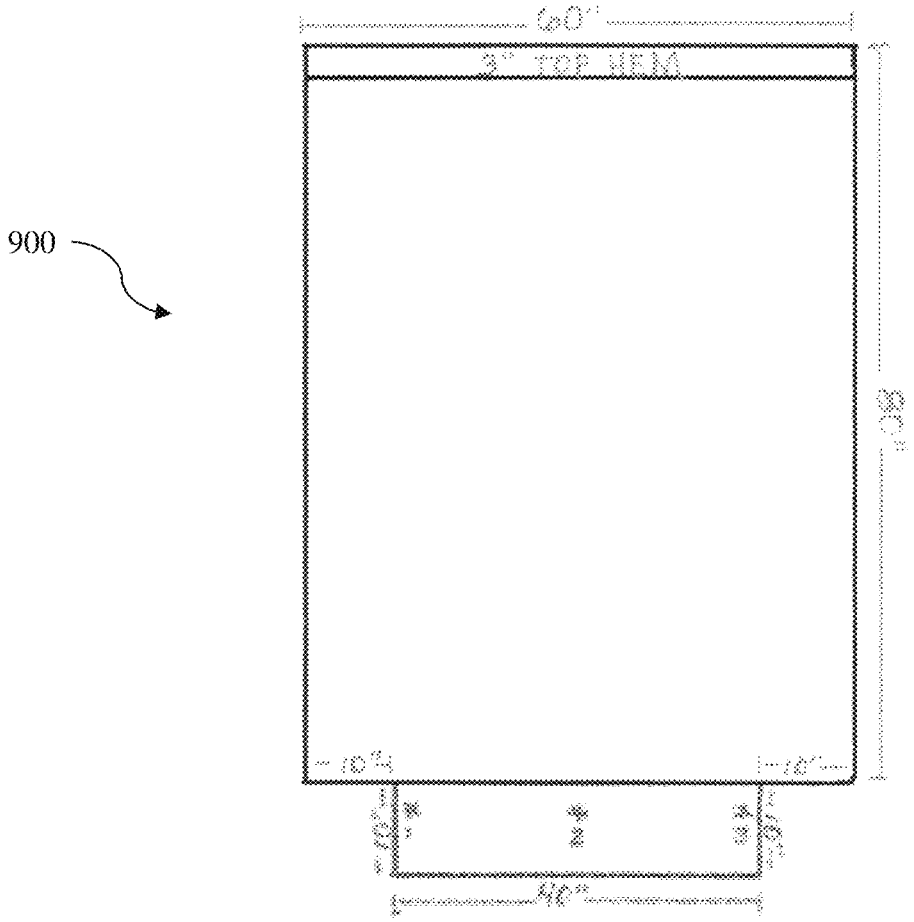
FIG. 9 depicts an embodiment of a Twin XL size top sheet.
Figure 10:
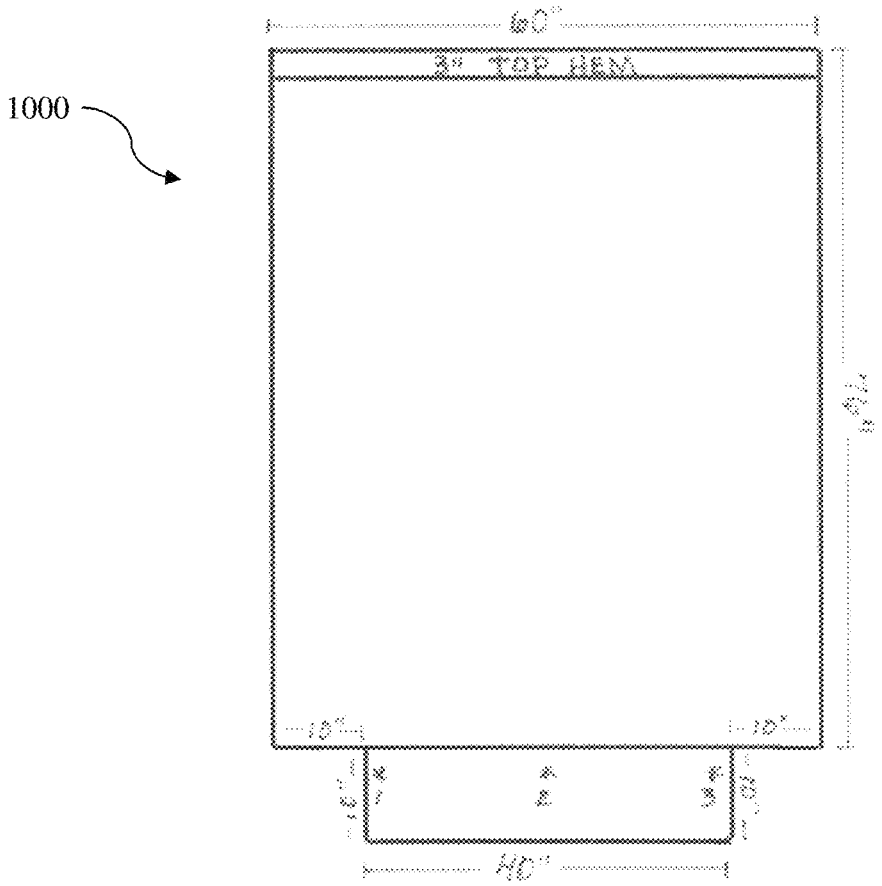
FIG. 10 depicts an embodiment of a Twin size top sheet.

FIG. 6 depicts an embodiment of a King size top sheet 600. FIG. 7 depicts an embodiment of a Queen size top sheet 700. FIG. 8 depicts an embodiment of a Full size top sheet 800. FIG. 9 depicts an embodiment of a Twin XL size top sheet 900. FIG. 10 depicts an embodiment of a Twin size top sheet 1000. The embodiments of the different sized top sheets shown in FIGS. 6-10 have similar design with different sizes and fixture placement to accommodate the corresponding sized bed. Therefore, the description of FIG. 6 also applies to FIGS. 7-10. The sheets disclosed herein may be comprised of any fabric, for example, cotton, wool, silk, burlap, felt, bamboo, hemp, nylon, linen, polyester, polypropylene, other cloths, other naturally occurring or manmade materials, and combinations thereof.

In the preferred embodiment, top sheet 600 is comprised of a single piece of material 660 with an extension 665 at the foot of the sheet. Preferably piece of material 660 is as long as the corresponding mattress. For example, piece of material 660 is preferably 80" long to accommodate the 80" length of a King size bed. However, piece of material 660 can be longer or shorter than the corresponding mattress. Preferably, the width of piece of material 660 is wider than the corresponding mattress such that that the sides of piece of material 660 can be tucked around and under the sides of the mattress. However, piece of material 660 can be as wide as the corresponding mattress or shorter than the corresponding mattress.

Preferably extension 665 is sewn onto the foot of piece of material 660. However, extension 665 can a continuous extension of piece of material 660, can be fastened with adhesive, staples, buttons, snaps, ties, another fastening device, or combinations thereof. Preferably, extension 665 is not as wide as the width of piece of material 660, thereby providing cutouts 670A and 670B. Cutouts 670A and 670B preferably allowed top sheet 660 to lay flat on top and along the sides of a mattress without bunching and/or overlapping in the corners. In the preferred embodiment, extension 665 is long enough to cover the foot of a mattress (i.e. is as long as the depth of the mattress). However, extension 665 can be longer or shorter than the depth of the mattress.

Preferably, extension 665 has one or more sheet coupling devices 675A-D. While four sheet coupling devices 675A-D are shown there can be more or fewer sheet coupling devices. For example, extension 665 may have 2, 3, 5, 6 or another number of sheet coupling devices. Preferably, the number of sheet coupling devices 675A-D is equal to the number of sheet coupling devices 120A-D. In the preferred embodiment, all of the sheet coupling devices are positioned within extension 665. By positioning all of the sheet coupling devices within extension 665, the sheets preferably will not restrict movement of the bed user into and out of the bed especially during an emergency. However, it is possible to position sheet coupling devices along the sides of piece of material 660 and/or along the head of piece of material 660. Preferably, the positioning of the sheet coupling device within top sheet 600 corresponds to the positioning of the sheet coupling device within fitted sheet 100.

Figure 11:
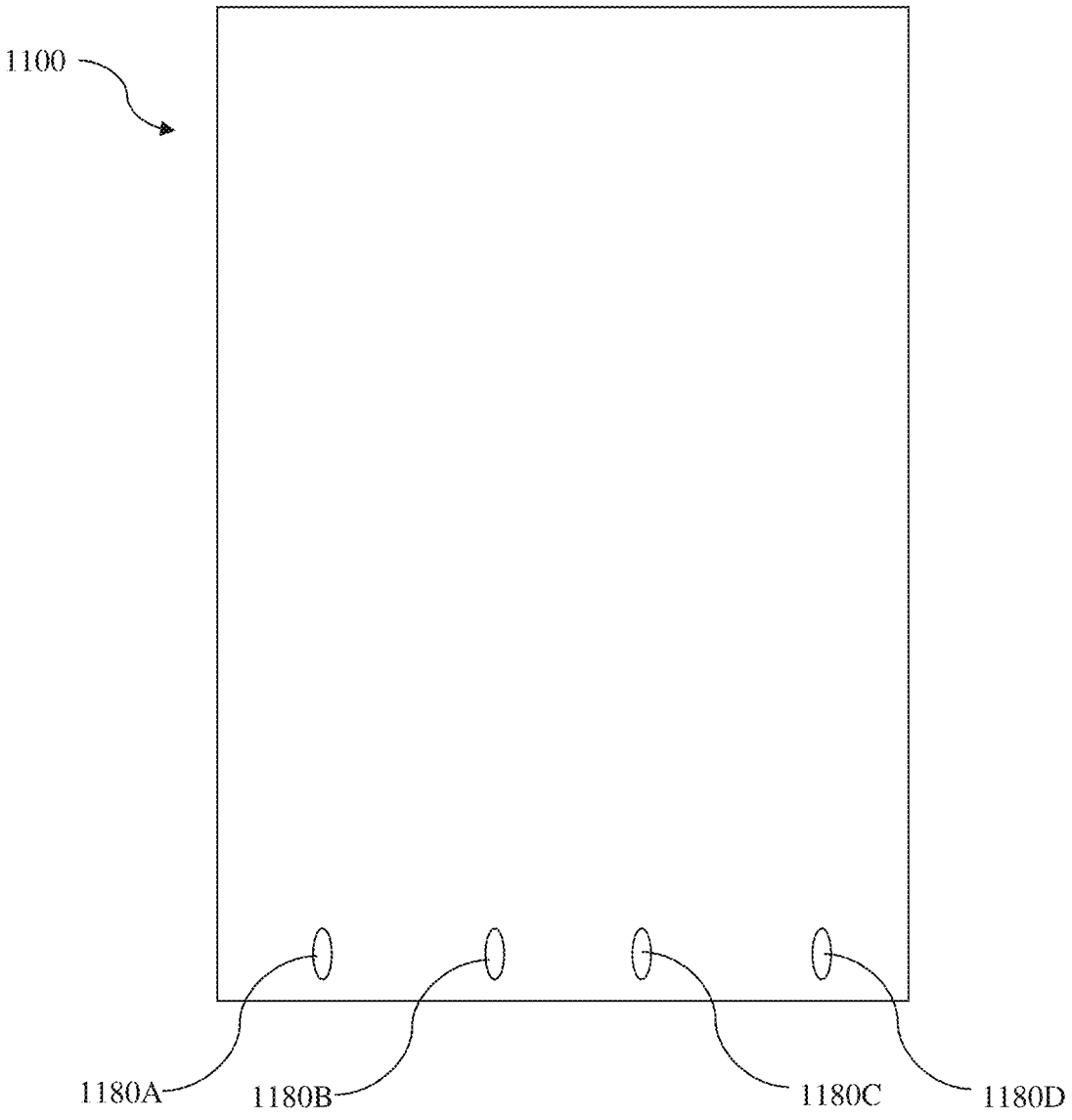
FIG. 11 depicts an embodiment of a comforter.

Sheet coupling devices may additionally be adapted to couple a blanket or quilt to the fitted sheet and/or the top sheet. For Example, FIG. 11 depicts an embodiment of a comforter 1100 having holes 1180A-D into which sheet coupling devices can be placed. Comforter 1100 may be used with or without a top sheet. While four holes 1180A-D are shown there can be more or fewer sheet coupling devices. For example, there may be 2, 3, 5, 6 or another number of holes. Preferably, the number of holes 1180A-D is equal to the number of sheet coupling devices 120A-D. Preferably, the positioning of the holes within comforter 1100 corresponds to the positioning of the sheet coupling device within fitted sheet 100.

Figure 12:
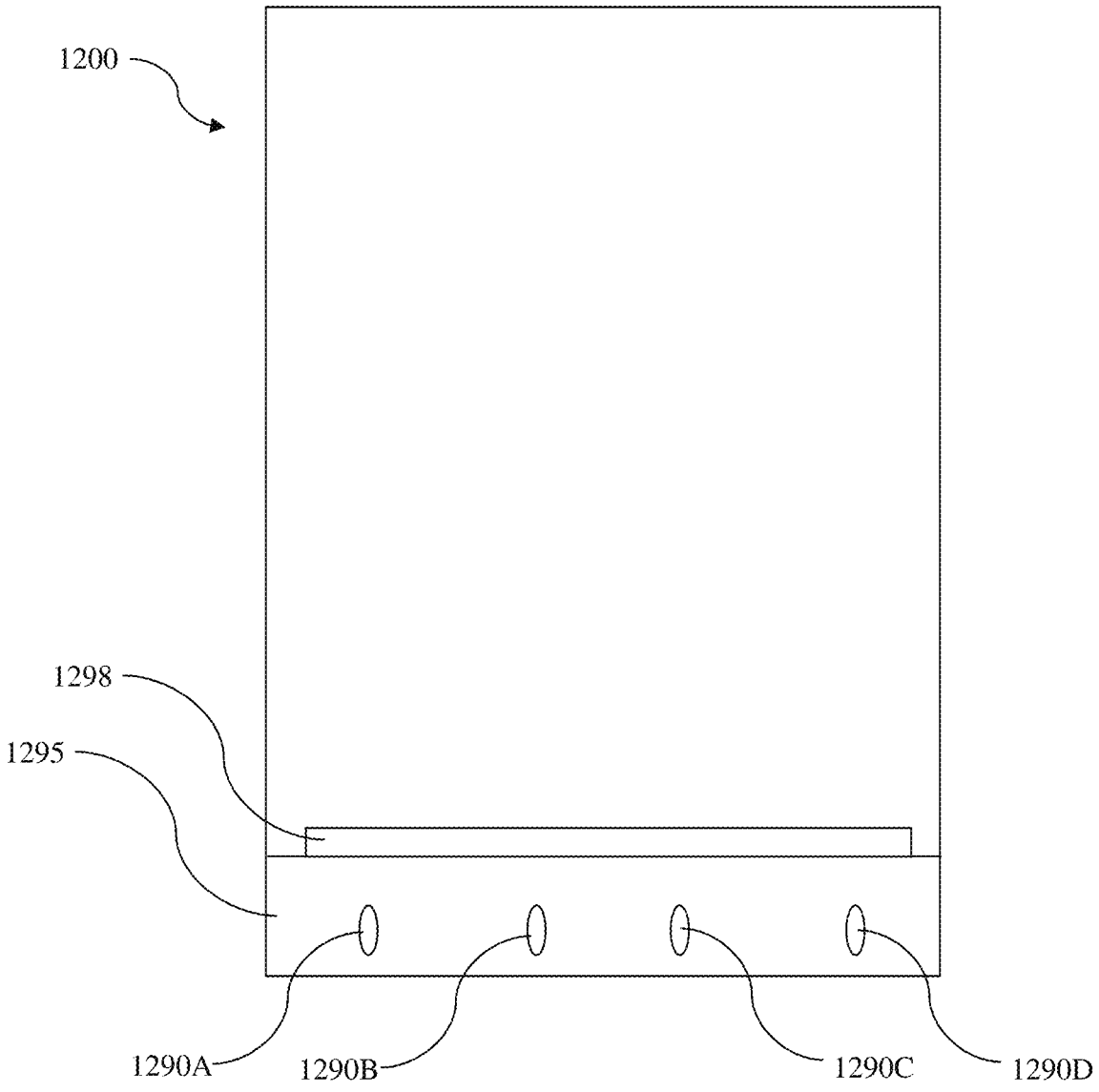
FIG. 12 depicts an embodiment of a duvet cover.

Similarly, a duvet cover 1200, as shown in FIG. 12, may be coupled to the sheet coupling devices. The duvet cover 1200 may have holes 1290A-D into which sheet coupling devices can be placed. As shown, holes 1290A-D may be positioned in an extension 1295 of the duvet cover 1200. For example, the duvet may be placed into the duvet cover 1200 through slot 1298 and extension 1295 may extend beyond the slot. Preferably, duvet cover 1200 and extension 1295 are made of the same material. Duvet cover 1200 may be used with or without a top sheet. While four holes 1290A-D are shown there can be more or fewer sheet coupling devices. For example, there may be 2, 3, 5, 6 or another number of holes. Preferably, the number of holes 1290A-D is equal to the number of sheet coupling devices 120A-D. Preferably, the positioning of the holes within duvet cover 1200 corresponds to the positioning of the sheet coupling device within fitted sheet 100.

Figure 13:
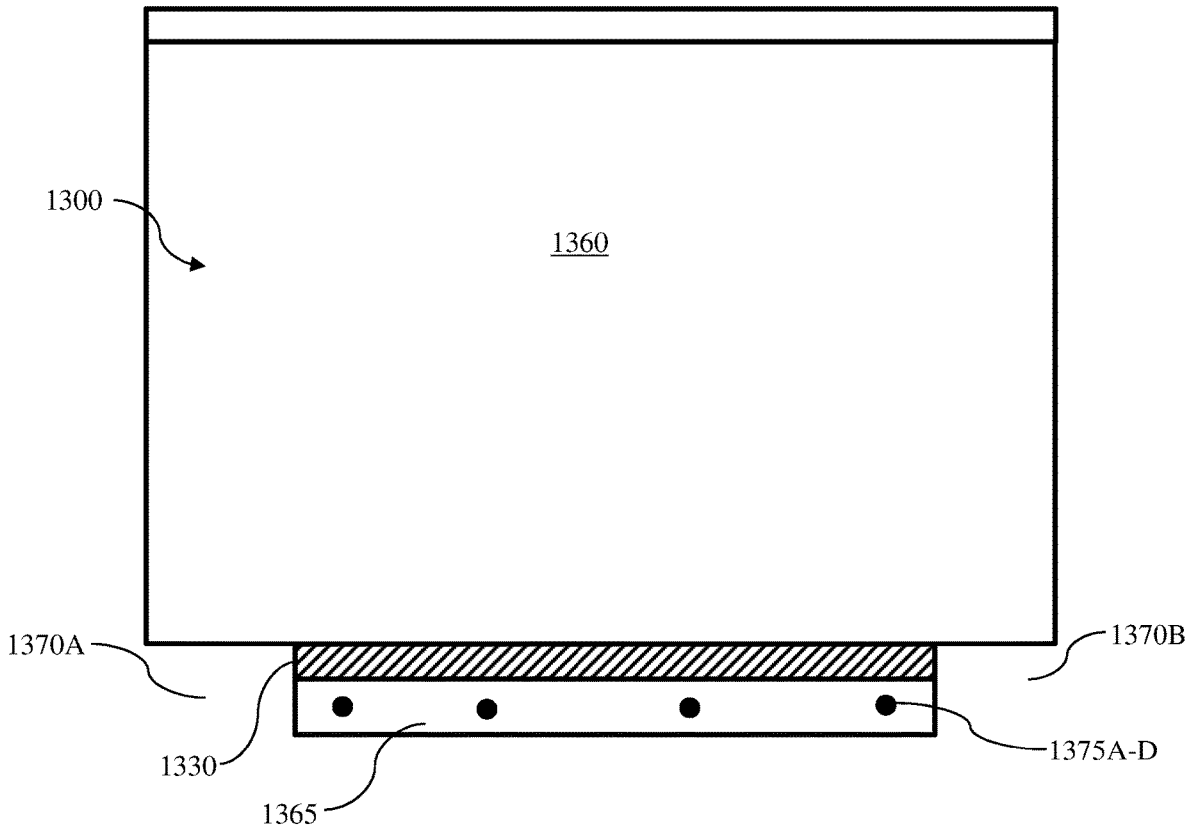
FIG. 13 depicts an embodiment of a top sheet with an elastic strip.

FIG. 13 depicts an embodiment of a top sheet 1300 with an elastic strip or zone 1330. Top sheet 1300 can be of any size, for example a king, queen, twin, extra-long versions thereof or another size. Preferably, top sheet 1300 is similar in construction to the other top sheets described herein with a single piece of material 1360 with an extension 1365 at the foot of the sheet. Preferably piece of material 1360 is as long as the corresponding mattress. For example, piece of material 660 is preferably sized to accommodate the corresponding mattress. Preferably, the width of piece of material 1360 is wider than the corresponding mattress such that that the sides of piece of material 1360 can be tucked around and under the sides of the mattress. However, piece of material 1360 can be as wide as the corresponding mattress or shorter than the corresponding mattress.

Preferably extension 1365 is attached to the foot of piece of material 1360 by elastic strip 1330. Preferably, extension 1365 is between 2 and 5 inches deep and is not as wide as the width of piece of material 1360, thereby providing cutouts 1370A and 1370B. Cutouts 1370A and 1370B preferably allowed top sheet 1300 to lay flat on top and along the sides of a mattress without bunching and/or overlapping in the corners. In the preferred embodiment, extension 1365 is long enough to cover the foot of a mattress (i.e. is as long as the depth of the mattress). However, extension 1365 can be longer or shorter than the depth of the mattress.

Elastic strip 1330 is preferably positioned between piece of material 1360 and extension 1365 and allows top sheet 1300 to more freely move during use than if elastic strip 1330 was not present. Additionally, elastic strip 1330 minimizes the amount of material used in piece of material 1360 and extension 1365. Elastic strip 1330 is preferably as wide as extension 1365, however in other embodiment elastic strip 1330 can be narrower or wider that extension 1365. Preferably elastic strip 1330 is made of a stretchable material or stretch fabric. For example elastic strip 1330 may be polymer-polyurethane rubber (Elastane, Lycra or Spandex), another rubber (naturally occurring or manmade), blended fabrics, and combinations thereof. Preferably elastic strip 1330 is made of a 2-way or 4-way stretchable fabric. Preferably, elastic strip 1330 is made of a material that is able to be stretched further than the material that piece of material 1360 and/or extension 1365 is made of. In other embodiments, the entire extension 1365 is made of a stretchable material.

Preferably, extension 1365 has one or more sheet coupling devices or holes 1375A-D. While four sheet coupling devices or holes 1375A-D are shown there can be more or fewer sheet coupling devices. For example, extension 1365 may have 2, 3, 5, 6 or another number of sheet coupling devices. In the preferred embodiment, all of the sheet coupling devices are positioned within extension 1365. By positioning all of the sheet coupling devices within extension 1365, the sheets preferably will not restrict movement of the bed user into and out of the bed especially during an emergency. However, it is possible to position sheet coupling devices along the sides of piece of material 1360 and/or along the head of piece of material 1360. Preferably, the positioning of the sheet coupling device within top sheet 1300 corresponds to the positioning of the sheet coupling device within fitted sheet 1400. Preferably, elastic strip 1330 relieves pressure on the fastening devices and button holes during use of the sheets to prevent failure thereof. The embodiments of duvet covers and comforters described herein, may also have elastic strips similar to elastic strip 1330.

Figure 14A:
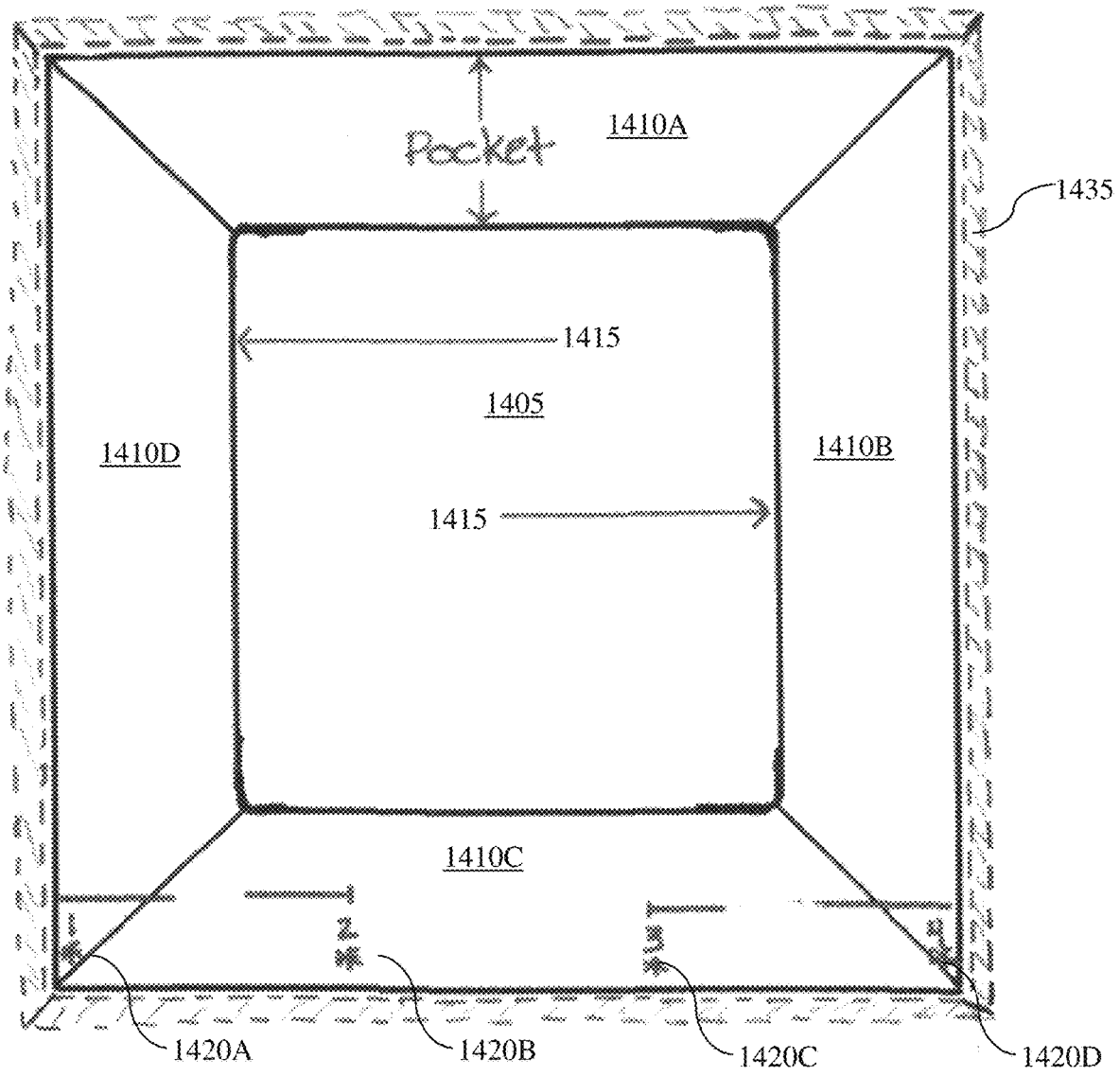
FIGS. 14A-C depict an embodiment of a bottom sheet with elastic strips.
Figure 14B:
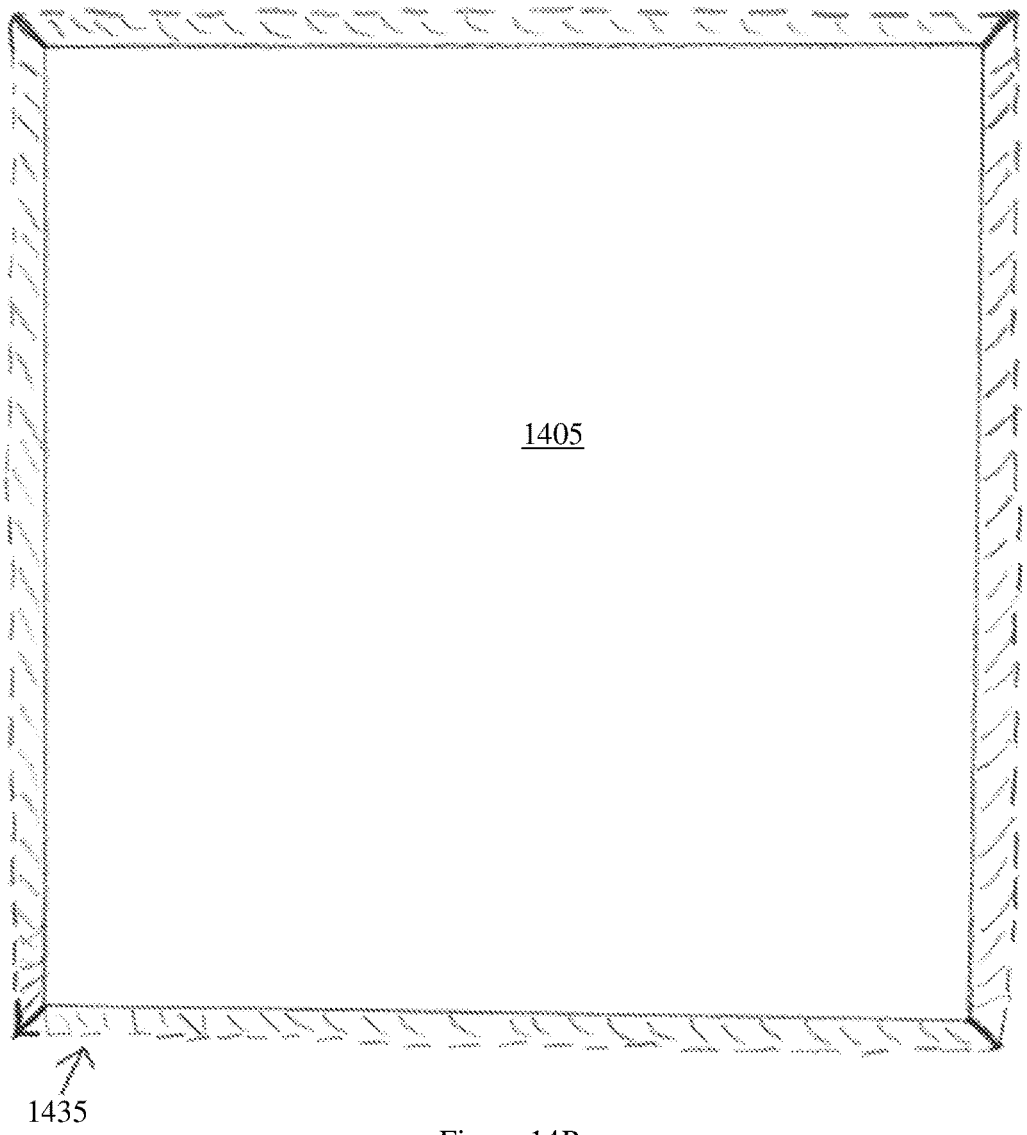
Figure 14C:
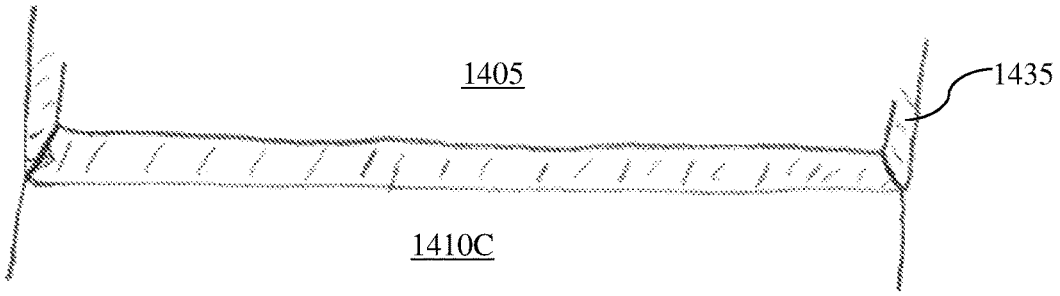

FIGS. 14A-C show bottom, top, and side views, respectively, of a fitted sheet 1400 with an elastic zone or strip 1435. Fitted sheet 1400 can be of any size, for example a king, queen, twin, extra-long versions thereof or another size. Fitted sheet 1400 is similar in construction to the other fitted sheets described herein with a flat top portion 1405 and side portions 1410A-D. Side portions 1410A-D preferably extend perpendicularly from flat top portion 1405 and are adapted to envelope the sides of a mattress. For example, as shown, side portions 1410A and 1410C have a length that corresponds with the length of the head and the foot of the appropriate mattress. Similarly, side portions 1410B and 1410D have a length that corresponds with the length of the sides of the appropriate mattress. Side portions 1410A-D preferably all have a depth that can accommodate multiple depth mattresses. For example, side portions 1410A-D may be 10" in depth, 12" in depth, 15" in depth, 17" in depth or another depth. Preferably, the edge of side portions 1410A-D that is opposite the edge that is attached to top portion 1405 has a securement device 1415 that is adapted to removably secure fitted sheet 1400 to a mattress. The securement device 1415 may be elastic, adhesive, ties, snaps, buttons, toggles, another device, or combinations thereof. In the preferred embodiment, fitted sheet 1400 is adapted to be placed on top of a mattress and side portions 1410A-D are adapted to envelop the sides of the mattress with the ends of side portions 1410A-D being secured under the mattress.

Preferably side portions 1410A-D are coupled to flat top portion 1405 via elastic strip 1435. In the preferred embodiment elastic strip 1435 is between 2 and 5 inches deep and spans all four sides of flat top portion 1405, however in other embodiments less than all four sides may be coupled to an elastic material. Preferably elastic strip 1435 is made of a stretchable material or stretch fabric. For example elastic strip 1435 may be polymer-polyurethane rubber (Elastane, Lycra or Spandex), another rubber (naturally occurring or manmade), blended fabrics, and combinations thereof. Preferably elastic strip 1435 is made of a 2-way or 4-way stretchable fabric. Preferably, elastic strip 1435 is made of a material that is able to be stretched further than the material that flat top portion 1405 and/or side portions 1410A-D is made of. In other embodiments, the entirety of side portions 1410A-D are made of a stretchable material. Elastic strip 1435 allows fitted sheet 1400 to more freely move during use than if elastic strip 1435 was not present. Additionally, elastic strip 1435 minimizes the amount of material used in top portion 1405 and side portions 1410A-D.

Preferably, side portion 1410C, which is preferably the foot of fitted sheet 1400 has one or more sheet coupling devices or holes 1420A-D. While four sheet coupling devices or holes 1420A-D are shown there can be more or fewer sheet coupling devices. For example, fitted sheet 1400 may have 2, 3, 5, 6 or another number of sheet coupling devices or holes. In the preferred embodiment, all of the sheet coupling devices are positioned along the foot portion of fitted sheet 1400. By positioning all of the sheet coupling devices along the foot of fitted sheet 1400, the sheets preferably will not restrict movement of the bed user into and out of the bed especially during an emergency. However, it is possible to position sheet coupling devices along the sides of fitted sheet 1400 and/or along the head of fitted sheet 1400. Preferably, each sheet coupling device is positioned within the side portions 1410A-D, however sheet coupling devices may be positioned on the top potion 1405 of fitted sheet 1400. Preferably, elastic strip 1435 relieves pressure on the fastening devices and button holes during use of the sheets to prevent failure thereof.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. A sheet set, comprising:

a fitted sheet comprising a top portion and four side portions, each side portion coupled to the top portion via one or more fitted sheet elastic strips, the fitted sheet adapted to be placed over a mattress;

a top sheet adapted to be placed atop the fitted sheet and having a first width;

a rectangular sheet extension coupled to a foot edge of the top sheet via a top sheet elastic strip and having a second width, wherein the second width is shorter than the first width;

wherein the elastic strip extends only along the foot edge of the top sheet and has a width equal to the width of the rectangular sheet extension; and at least one fastening device adapted to couple the sheet extension of the top sheet to the fitted sheet.

2. The sheet set of claim 1, wherein the at least one fastening device is a button coupled to a foot of the fitted sheet and is adapted to engage a button hole in the sheet extension.

3. The sheet set of claim 1, wherein the at least one fastening device is a button coupled to the sheet extension and is adapted to engage a button hole in a foot of the fitted sheet.

4. The sheet set of claim 1, wherein the at least one fastening is adapted to engage both a button hole in a foot of the fitted sheet and a button hole in the sheet extension.

5. The sheet set of claim 1, further comprising a cutout on each side of sheet extension and adapted to allow the top sheet to lay flat on top of the fitted sheet.

6. The sheet set of claim 5, wherein the top sheet lays flat without bunching or overlapping in the corners.

7. The sheet set of claim 1, wherein the at least one fastening device only couples a foot of the fitted sheet to the sheet extension.

8. The sheet set of claim 1, further comprising a securement device coupled to one or more edges of the fitted sheet adapted to secure the fitted sheet to the mattress.

9. The sheet set of claim 1, wherein the top sheet, without the sheet extension, has a length equal to a length of the mattress.

10. The sheet set of claim 1, wherein the at least one fastening device is positioned along a foot side of the mattress.

11. The sheet set of claim 1, wherein the sheet extension has a length equal to the depth of the mattress.

12. The sheet set of claim 1, further comprising one of a comforter and a duvet cover.

13. The sheet set of claim 12, wherein the at least one fastening device is adapted to engage a hole in the comforter or duvet cover.

14. The sheet set of claim 12, wherein the duvet cover comprises an extension with at least one hole adapted to receive the at least one fastening device.

* * * * *